US008348239B2

(12) United States Patent
Chou

(10) Patent No.: US 8,348,239 B2
(45) Date of Patent: Jan. 8, 2013

(54) CLUTCHABLE PRY BAR

(76) Inventor: Yeh-Chien Chou, Taoyuan Hsien (TW)

( * ) Notice: Subject to any disclaimer, the term of this patent is extended or adjusted under 35 U.S.C. 154(b) by 386 days.

(21) Appl. No.: 12/748,628

(22) Filed: Mar. 29, 2010

(65) Prior Publication Data

US 2011/0233491 A1 Sep. 29, 2011

(51) Int. Cl.
*B66F 15/00* (2006.01)

(52) U.S. Cl. ..... 254/108; 254/218; 254/223; 254/247; 254/106; 254/109; 410/100; 410/103; 24/68 CD

(58) Field of Classification Search ..... 254/100, 254/103, 106–112, 218, 223, 243, 217, 222, 254/240, 247; 410/100, 103; 81/58, 60; 24/68 CD See application file for complete search history.

(56) References Cited

U.S. PATENT DOCUMENTS

| | | | | |
|---|---|---|---|---|
| 4,510,651 | A * | 4/1985 | Prete et al. | 24/68 R |
| 4,625,945 | A * | 12/1986 | Hearn et al. | 254/25 |
| 5,433,565 | A * | 7/1995 | Chan | 410/103 |
| 6,854,939 | B2 * | 2/2005 | Im | 410/100 |
| 7,410,334 | B2 * | 8/2008 | McGrew | 410/100 |
| 2007/0221897 | A1 * | 9/2007 | Cardona | 254/218 |
| 2011/0150595 | A1 * | 6/2011 | Foryan | 410/103 |

* cited by examiner

*Primary Examiner* — Robert Canfield

(57) ABSTRACT

A clutchable pry bar includes a bar member with a fitting connector; a rack member fitted with the fitting connector of the bar member, including two slots adjacent to a closed end of the rack member, and including two through holes proximate to an opened end of the rack member; a ratchet shaft inserted to the through hole of the rack member, and including a first end portion disposed on one end thereof; at least one ratchet member fitted to the ratchet shaft, a plate member movably fixed to the slots of the rack member, a returning spring between pegs of the plate member and a central extension of the bar member; a stem member to be retained with the ratchet shaft after the stem member is inserted to a radial bore of the ratchet shaft.

9 Claims, 7 Drawing Sheets

CLUTCHABLE PRY BAR

BACKGROUND OF THE INVENTION

1. Field of the Invention

The present invention relates to a clutchable pry bar used in winch.

2. Description of the Prior Art

As shown in FIG. 1, a conventional winch A includes a rotary shaft A2 with a plurality of slots A1 inserted to a U-shaped frame A3, and one end of the rotary shaft A2 is used to extends out of a head member A4 to be used to insert a pry bar B so as to be rotated, and the rotary shaft A2 includes a ratchet member 5 and a paw member (not shown) disposed on another end thereof to prevent the rotary shaft A2 from being released after being rotated tightly, thus banding objects securely. However, in operation, when rotating the pry bar once more, the pry bar B has to be pulled out to be inserted to another hole A6, having a repeated operation time-consumlingly.

The present invention has arisen to mitigate and or obviate the afore-described disadvantages.

SUMMARY OF THE INVENTION

The primary object of the present invention is to provide a clutchable pry bar which is capable of overcoming the shortcomings of the conventional pry bar.

Another object of the present invention is to provide a clutchable pry bar that can be operated reciprocately on the head member of the winch to pull a belt of the head member tightly, quickly, and effortlessly.

To obtain the above objective, a clutchable pry bar provided by a preferred embodiment of the present invention comprises:

a bar member;

a rack member formed in a U shape to be fitted with the fitting connector of the bar member, including two slots arranged on two sides thereof individually adjacent to a closed end of the rack member, and including two through holes fixed on the two sides thereof respectively proximate to an opened end of the rack member;

a ratchet shaft inserted to the through hole of the rack member, and including a first end portion with a radial bore disposed on one end thereof;

a locking member to lock the ratchet shaft to another side of the rack member;

at least one ratchet member fitted to the ratchet shaft, wherein the ratchet member includes a plurality of toothed recesses arranged around an outer periphery thereof;

a plate member movably fixed to the slots of the rack member, and including a toothed block to engage with the ratchet members, including a number of pegs extending outward from the toothed block relative to the closed end of the rack member;

a returning spring between the pegs of the plate member and the central extension of the bar member so that the plate member moves between the slots of the rack member;

a stem member including a large-diameter segment inserted through the radial bore of the ratchet shaft, and including at least one ball mounted thereon to retain the stem member with the ratchet shaft after the stem member is inserted to the radial bore of the ratchet shaft.

DETAILED DESCRIPTION OF THE PREFERRED EMBODIMENTS

Figure 1:
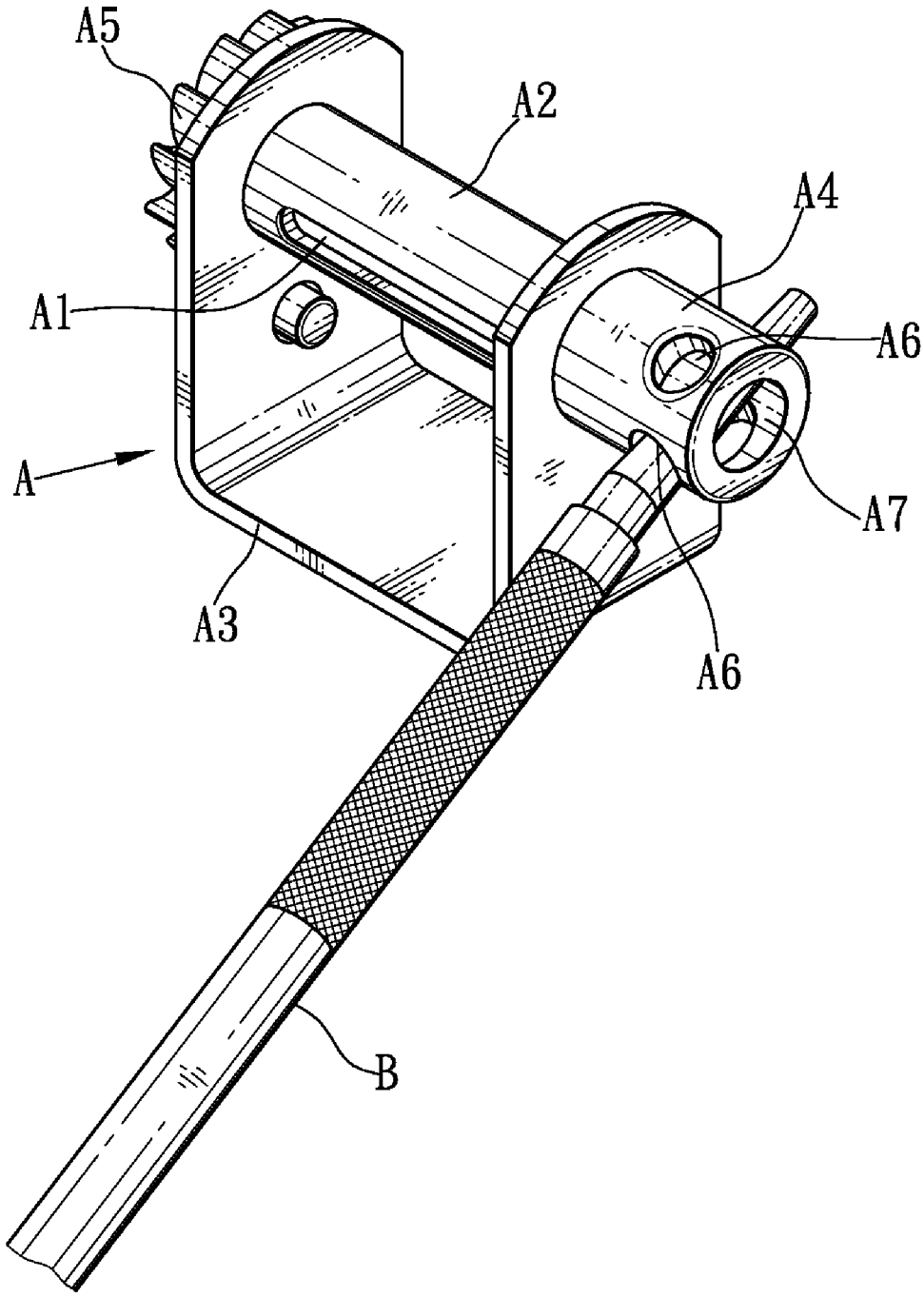
Fig. 1 PRIOR ART
FIG. 1 is a perspective view of a conventional pry bar.
Figure 2:
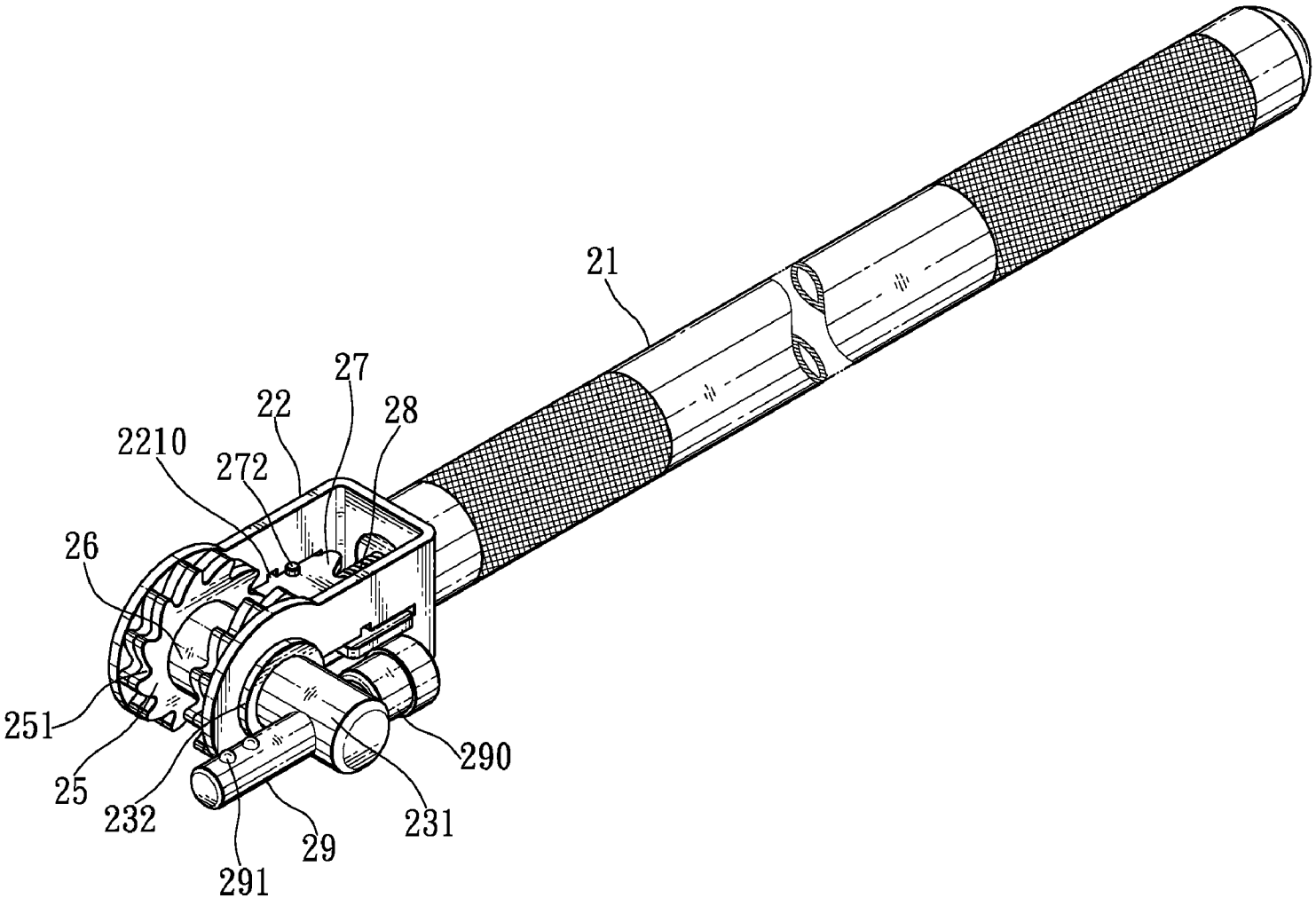
FIG. 2 is a perspective view showing the assembly of a clutchable pry bar according to a preferred embodiment of the present invention.
Figure 3:
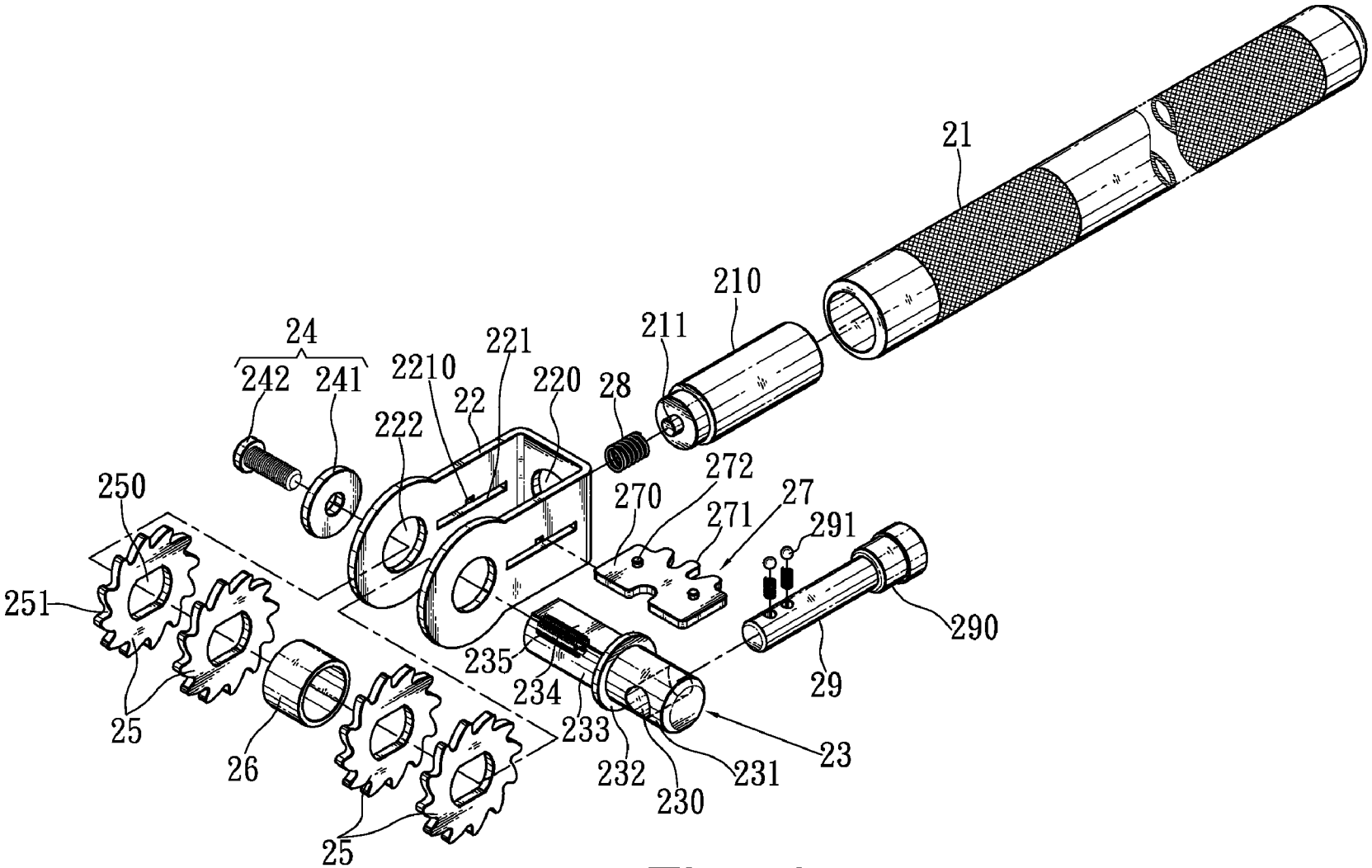
FIG. 3 is a perspective view showing the exploded components of the clutchable pry bar according to the preferred embodiment of the present invention.
Figure 4:
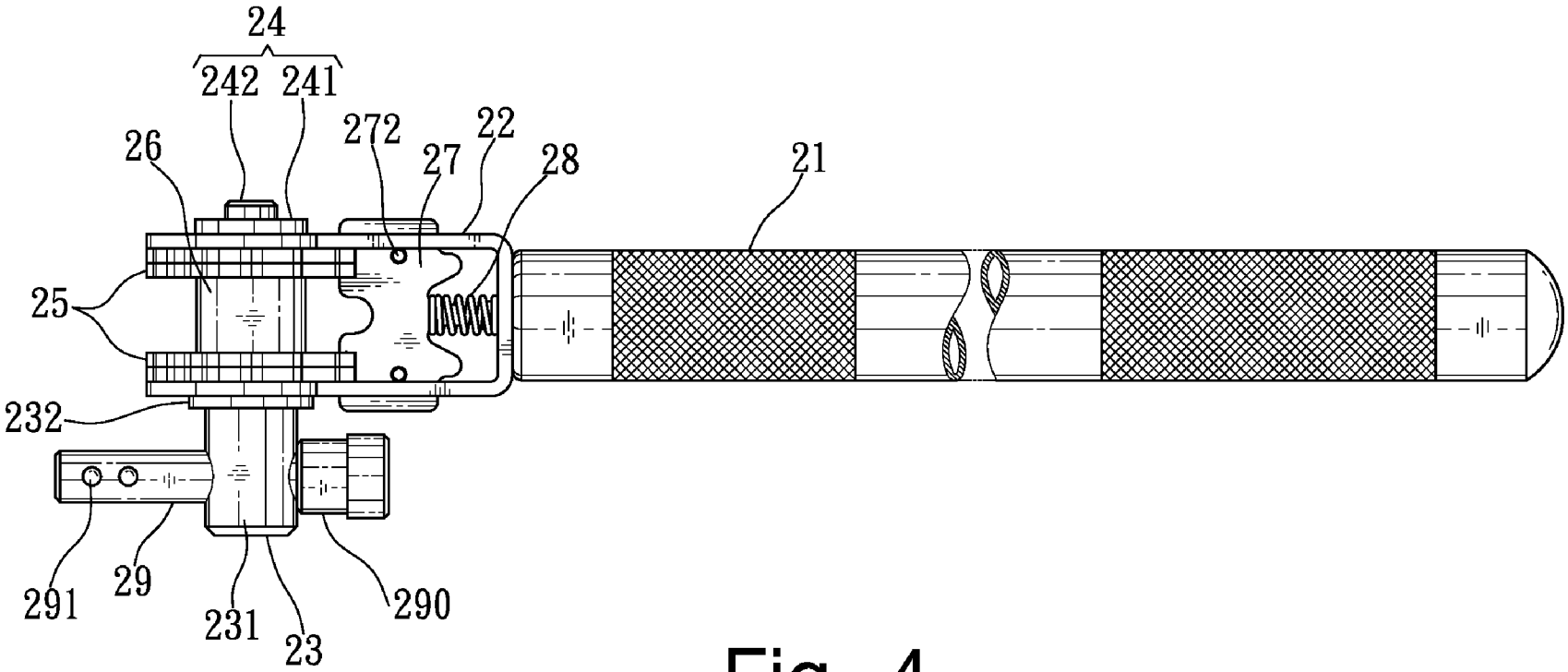
FIG. 4 is a top plan view showing the assembly of the clutchable pry bar according to the preferred embodiment of the present invention.
Figure 5:
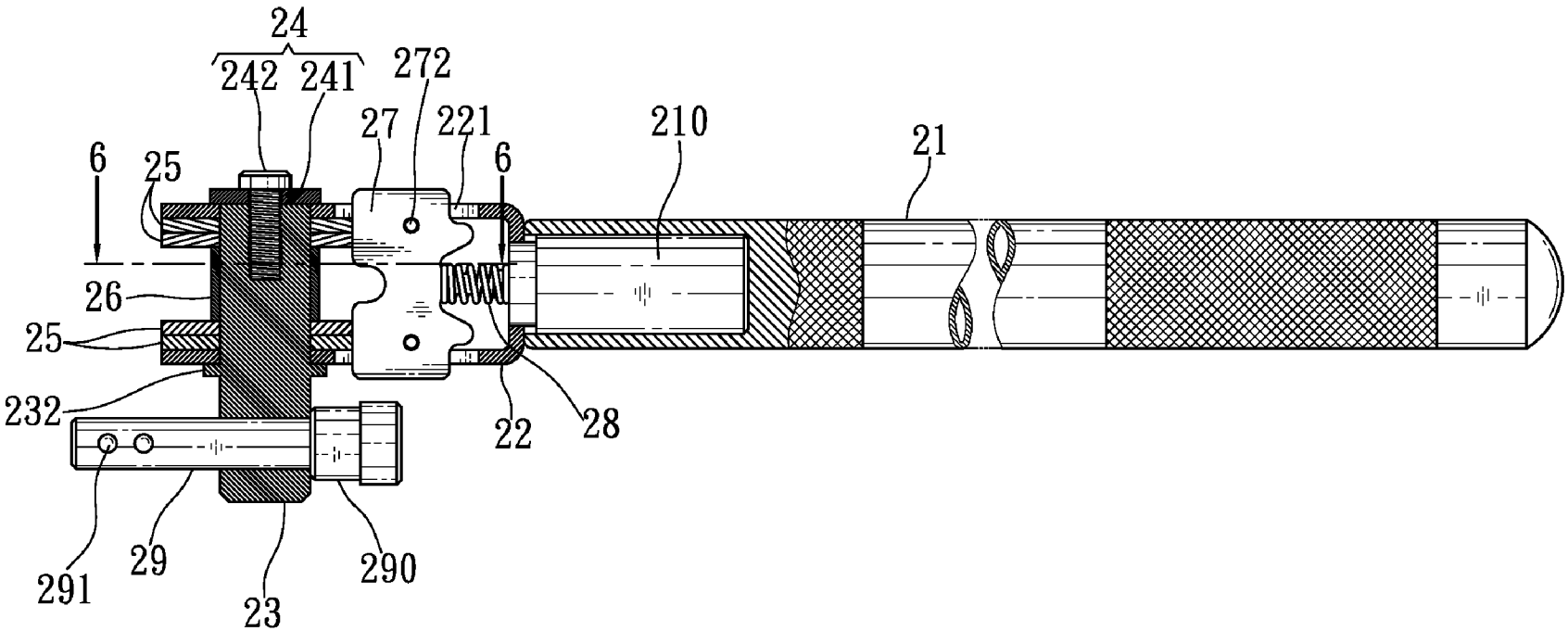
FIG. 5 is a cross sectional view showing the assembly of the clutchable pry bar according to the preferred embodiment of the present invention.

Referring to FIGS. 2-5, a clutchable pry bar according to a preferred embodiment of the present invention comprises:

a bar member 21 including a fitting connector 210 fitted on one end thereof, the fitting connector 210 including a central extension 211 disposed on a top end surface thereof;

a rack member 22 formed in a U shape and including an opening 220 mounted on a closed end thereof to fit the fitting connector 210 of the bar member 21, including two slots 221 arranged on two sides thereof individually adjacent to the closed end of the rack member 22, and including two through holes 222 fixed on the two sides thereof respectively proximate to an opened end of the rack member 22, wherein each slot 221 includes a cutout 2210 formed thereabove;

a ratchet shaft 23 inserted to the through hole 222 of the rack member 22, and including a first end portion 231 with a radial bore 230 disposed on one end thereof, including a stopping shoulder 232 connected with the first end portion 231 and extending radially from an outer rim thereof, and including a second end portion 233 mounted on another end thereof to be inserted to the holes 222 of the rack member 22, such that the first end portion 231 of the ratchet shaft 23 is limited outside the rack member 22 by using the stopping shoulder 232, and the second end portion 233 including two opposite tangent planes 234 fixed thereon individually, and including an aperture 235 formed therein;

a locking member 24 having a lock ring 241 and a bolt 242 to lock the ratchet shaft 23 to another side of the rack member 22;

at least one ratchet member 25 fitted to the ratchet shaft 23, wherein there are four ratchet members 25 provided in this embodiment, and the four ratchet members 25 are arranged on two inner walls of the two sides of the rack members 22 respectively by ways of a sleeve member 26, and the ratchet member 25 includes a central orifice 250 secured thereon in response to the two opposite tangent planes 234 of the rack member 23, and includes a plurality of toothed recesses 251 arranged around an outer periphery thereof;

a plate member 27 movably fixed to the slots 221 of the rack member 22, and including a toothed block 270 to engage with the ratchet members 25, including a number of pegs 271 extending outward from the toothed block 270 relative to the closed end of the rack member 22, and including two bosses 272 mounted on a top surface of the toothed block 270 in response to the cutouts 2210 of the slots 221 so as to be inserted through the cutouts 2210 of the slots 221 to be retain on the two inner walls of the two sides of the rack members 22, such that the plate member 27 is positioned in the slots 221;

a returning spring 28 between the pegs 271 of the plate member 27 and the central extension 211 of the bar member 21 so that the plate member 27 moves between the slots 221 of the rack member 22;

a stem member 29 including a large-diameter segment 290 inserted through the radial bore 230 of the ratchet shaft 23, and including at least one ball 291 mounted thereon to retain the stem member 29 with the ratchet shaft 23 after the stem member 29 is inserted to the radial bore 230 of the ratchet shaft 23.

Figure 6:
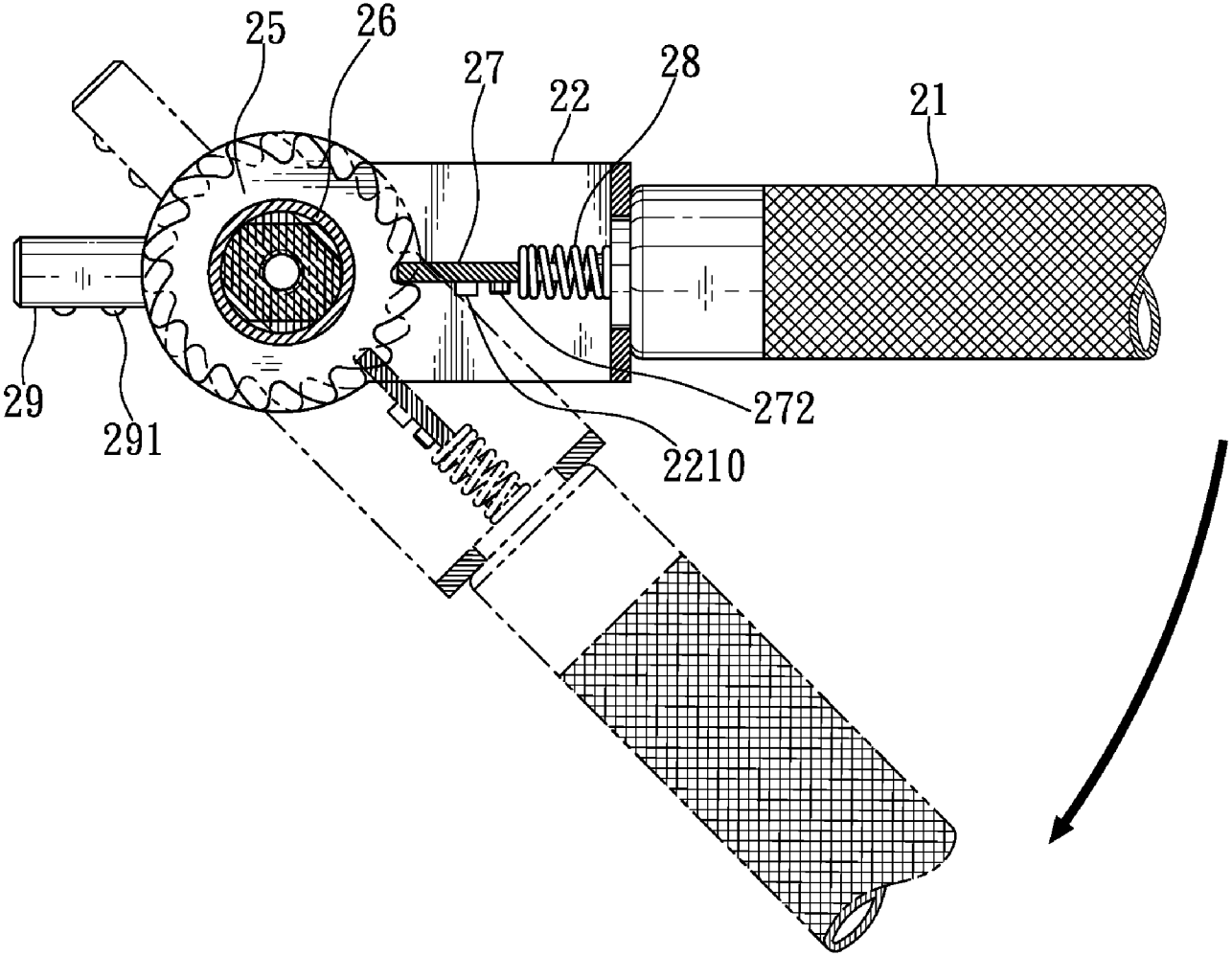
FIG. 6 is a cross sectional view showing the operation of the clutchable pry bar according to the preferred embodiment of the present invention and taken along the lines 6-6 of FIG. 5.
Figure 7:
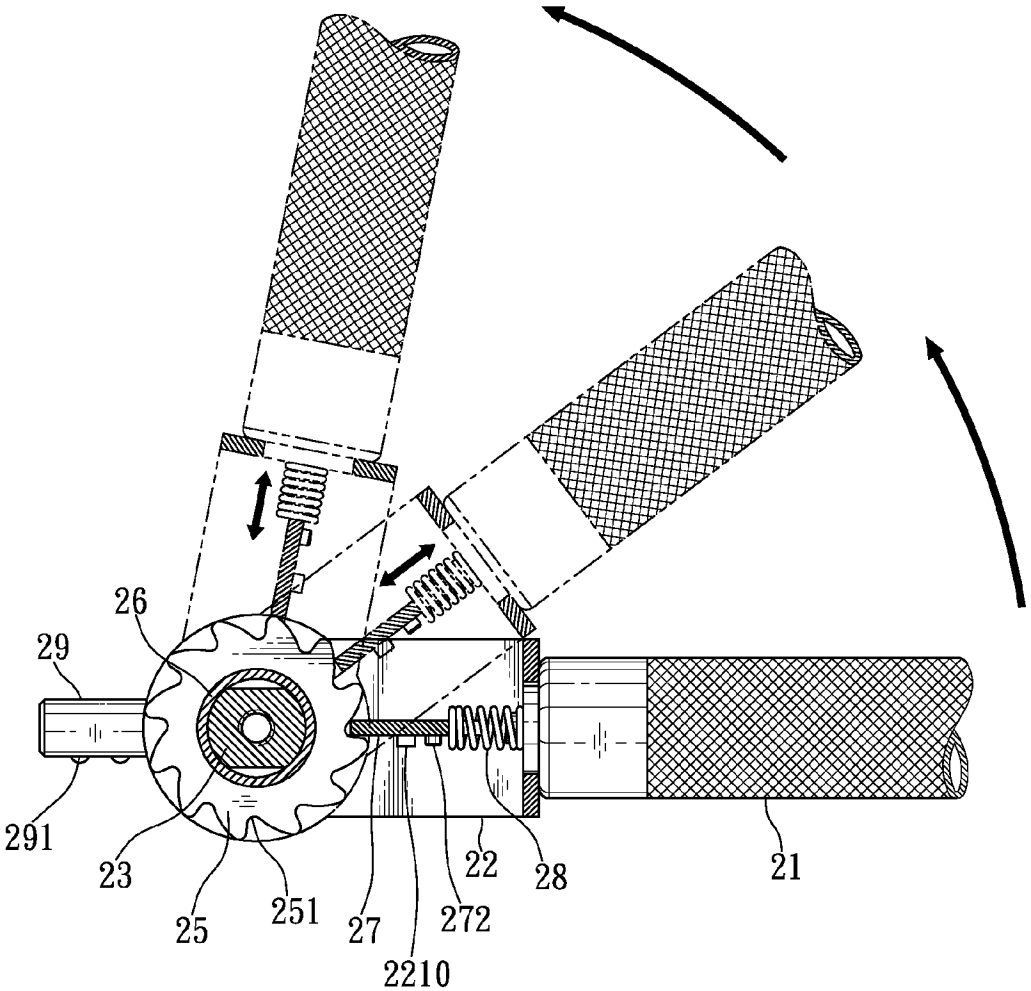
FIG. 7 is another cross sectional view showing the operation of the clutchable pry bar according to the preferred embodiment of the present invention and taken along the lines 6-6 of FIG. 5.

In assembly, as shown in FIGS. 6 and 7, the bar member 21 is rotated to actuate the rack member 22 to rotate toward a predetermined direction, and the ratchet shaft 23 abuts against the ratchet member 25 by using the toothed recesses 251 and the plate member 27 so as to prevent the toothed recesses 251 which rotate from a deep-to-shallow direction from rotating idly when the returning spring 28 retracts inward, and when the toothed recesses 251 rotate from a shallow-to-deep direction, the plate member 27 engages with the toothed recesses 251 so that the ratchet member 25 rotates with the ratchet shaft 23. In operation, the stem member 29 is inserted to an axial mouth of a head member of a winch to be retained by ways of the balls 291, hence when the ratchet member 25 and the plate member 27 rotate in a retaining direction, the stem member 29 is actuated to rotate so that the ratchet shaft 23 actuates the head member of the winch by means of the stem member 29. Furthermore, when the ratchet member 25 and the plate member 27 rotate in an idly rotating direction, the stem member 29 can not actuate the head member of the winch so that the pry bar allows to be operated reciprocately on the head member of the winch to pull a belt of the head member tightly, quickly, and effortlessly.

While we have shown and described various embodiments in accordance with the present invention, it is clear to those skilled in the art that further embodiments may be made without departing from the scope of the present invention.

What is claimed is:

1. A clutchable pry bar comprising:

a bar member;

a rack member formed in a U shape to be fitted with a fitting connector of the bar member, including two slots arranged on two sides thereof individually adjacent to a closed end of the rack member, and including two through holes defined on the two sides thereof respectively proximate to an opened end of the rack member;

a ratchet shaft inserted to the two through holes of the rack member; and including a first end portion with a radial bore disposed on one end thereof;

a locking member for locking the ratchet shaft to another side of the rack member;

at least one ratchet member fitted to the ratchet shaft, wherein the ratchet member includes a plurality of toothed recesses arranged around an outer periphery thereof;

a plate member movably, fixed to the two slots of the rack member, including a toothed block to engage with the ratchet members, and including a number of pegs extending outward from the toothed block relative to the closed end of the rack member;

a returning spring between the pegs of the plate member and a central extension of the bar member so that the plate member moves between the two slots of the rack member;

a stem member, including a large-diameter segment, inserted through the radial bore of the ratchet shaft, and including at least one ball mounted thereon to retain the stem member with the ratchet shaft after the stem member is inserted to the radial bore of the ratchet shaft.

2. The clutchable pry bar as claimed in claim 1, wherein the bar member includes a fitting connector fitted on one end thereof.

3. The clutchable pry bar as claimed in claim 2, wherein, the fitting connector includes a central extension disposed on a top end surface thereof.

4. The clutchable pry bar as claimed in claim 1, wherein the rack member includes an opening defined on the closed end thereof, and each slot includes a cutout formed thereabove.

5. The clutchable pry bar as claimed in claim 1, wherein the ratchet shaft includes a stopping shoulder connected with the first end portion and extending radially from an outer rim thereof, and includes a second end portion mounted on another end thereof to be inserted to the holes of the rack member, such that the first end portion of the ratchet shaft is limited outside the rack member by using the stopping shoulder, and the second end portion includes two opposite tangent planes fixed thereon individually, and includes an aperture formed therein.

6. The clutchable pry bar as claimed in claim 1, wherein the locking member includes a lock ring and a bolt.

7. The clutchable pry bar as claimed in claim 1, wherein the ratchet member includes a central orifice defined thereon and corresponding to two opposite tangent planes of the rack member.

8. The clutchable pry bar as claimed in claim 1, wherein the plate member includes two bosses mounted on a top surface of the toothed block and corresponding to the cutouts of the slots.

9. The clutchable pry bar as claimed in claim 8, wherein the bosses are inserted through the cutouts of the slots to be retained on two inner walls of the two sides of the rack members, such that the plate member is positioned in the slots.

* * * * *